United States Patent [19]

Settlemire

[11] 4,280,035

[45] Jul. 21, 1981

[54] PLURAL KEY ACTUATED TOTALIZER FOR GASOLINE SALES PUMP

[75] Inventor: Eugene F. Settlemire, Tuscon, Ariz.

[73] Assignee: Austin A. Webb, Kalamazoo, Mich.

[21] Appl. No.: 121,099

[22] Filed: Feb. 13, 1980

Related U.S. Application Data

[63] Continuation-in-part of Ser. No. 6,534, Jan. 25, 1979, Pat. No. 4,217,485.

[51] Int. Cl.[3] ..... B67D 5/22

[52] U.S. Cl. ..... 235/94 R; 235/117 R

[58] Field of Search ..... 235/94 R, 95 R, 117 R

[56] References Cited

U.S. PATENT DOCUMENTS

| | | | |
|---|---|---|---|
| 3,026,032 | 3/1962 | Settlemire | 235/94 R |
| 3,422,676 | 1/1969 | Wilson | 235/94 R |

*Primary Examiner*—L. T. Hix
*Assistant Examiner*—Benjamin R. Fuller
*Attorney, Agent, or Firm*—Austin A. Webb

[57] ABSTRACT

Plural totalizers having axially shiftable shafts, and key actuated locks for moving the shafts, are mounted on a plate adapted to be connected over an opening in the case of a gasoline sales pump. Plural key actuated locks with lugs on the undersides of their cylinders selectively cam the ends of the shafts to connect one shaft to a shaft driven by the sales register of the pump. Detents co-act with slides on the bottom of each cylinder to permit only one cylinder and totalizer shaft to be engaged at a time. One detent closes a switch on the plate when actuated to complete a circuit to the pump delivery device. The other detent is actuated by a lever supported on the plate and adapted to be connected to the reset lever of the pump to release both detents and a first actuated lock cylinder prior to a succeeding actuation of the pump. Flanges turned from the plate support the totalizers with the shafts of the totalizers projecting therefrom. The lock bodies are connected opposite the ends on the shafts to another flange turned from the plate. The lock cylinders require key rotation before axial movement, and slots in the lock bodies receive the lugs to prevent axial motion until the cylinders are rotated.

7 Claims, 3 Drawing Figures

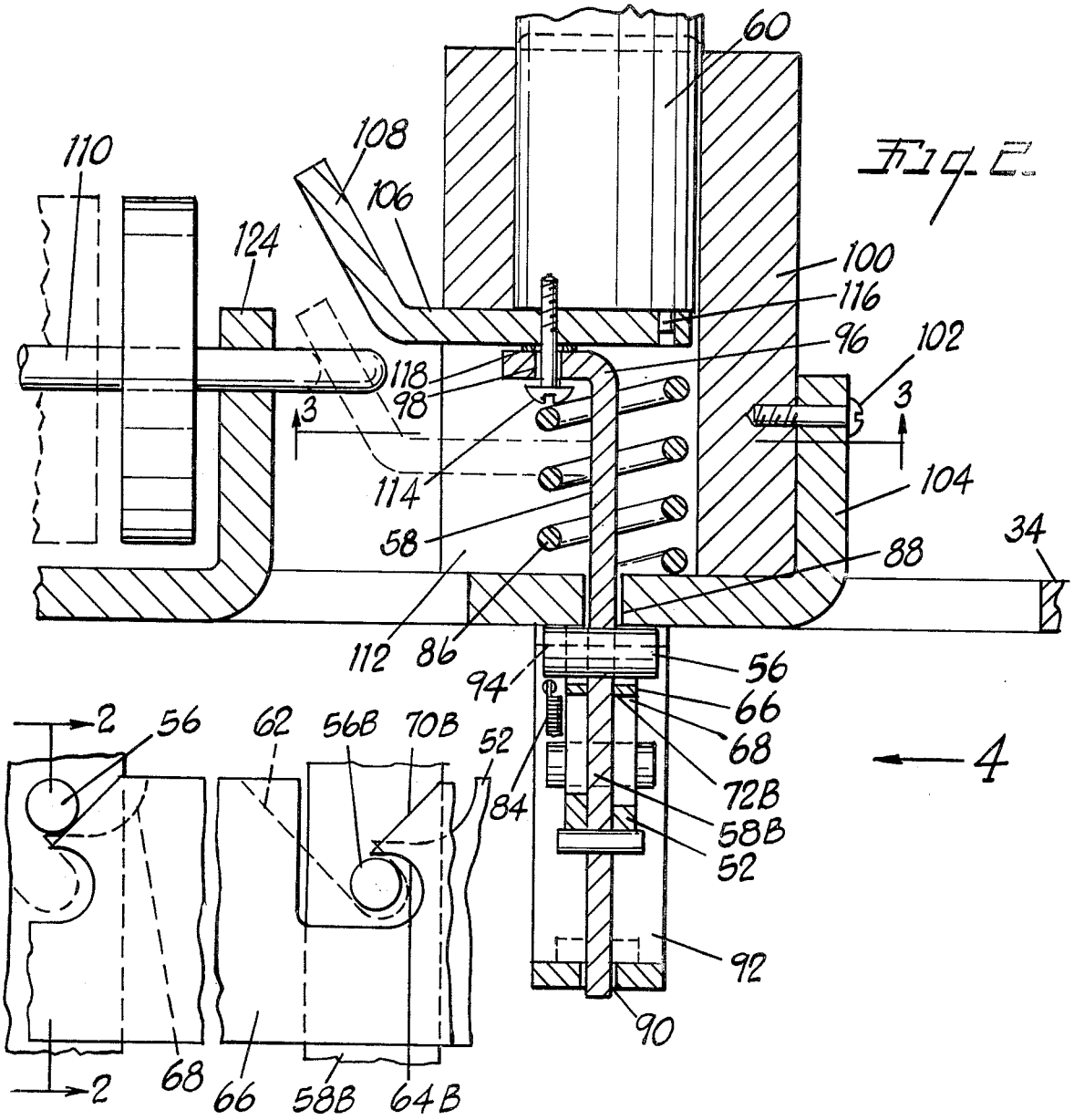
Fig. 2
Fig. 4
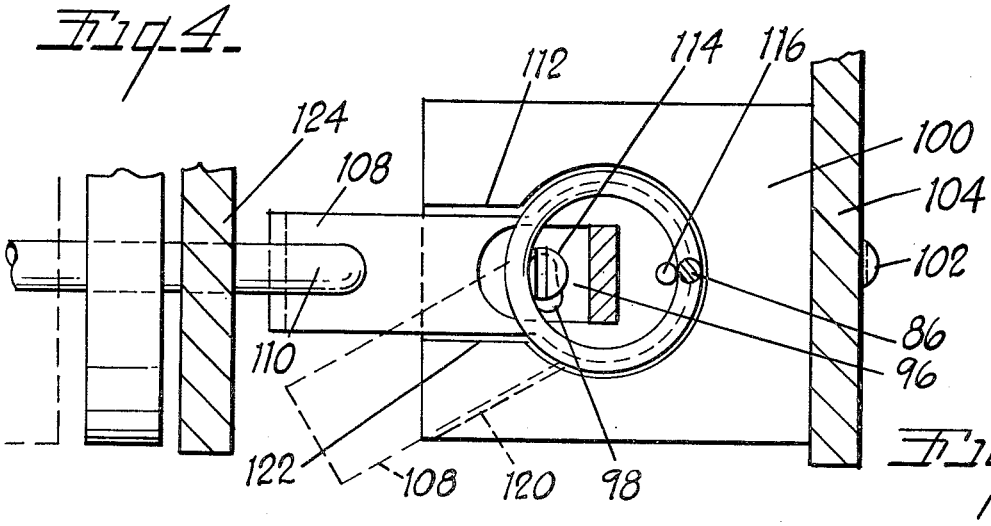
Fig. 3

PLURAL KEY ACTUATED TOTALIZER FOR GASOLINE SALES PUMP

RELATED APPLICATIONS

This application is a continuation in part of my copending application, Ser. No. 6,534 filed Jan. 25, 1979, now U.S. Pat. No. 4,217,485 for an invention of the same name.

DETAILED DESCRIPTION

The drawings, of which there are two sheets, illustrate a preferred construction of the lock, detent, totalizer, switch and release assembly.

FIG. 2 is an enlarged, fragmentary, cross sectional view taken along the plane of the line 2—2 in FIGS. 1 and 4 and looking in the direction of the arrows.

FIG. 3 is a projected and fragmentary cross sectional view taken along the plane of the line 3—3 in FIG. 2 and looking in the direction of the arrows.

FIG. 4 is a fragmentary, enlarged, side elevational view of the detent slides and the detent control bars, as viewed from the arrow in FIG. 2.

Figure 1:
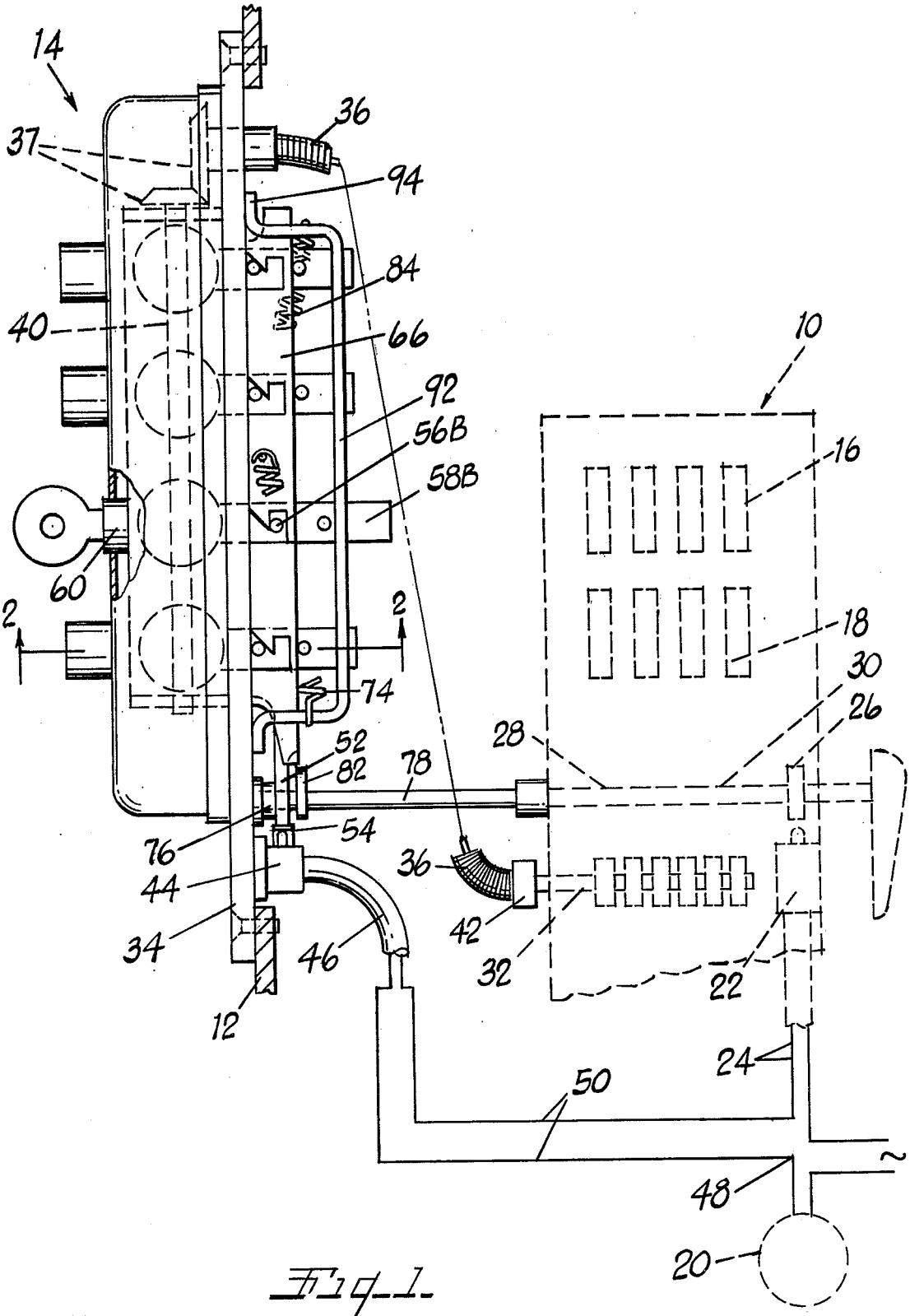
FIG. 1 is a side elevational view of the assembly mounted on a wall of a gasoline sales pump. Parts of the sales pump to which the assembly is connected are shown conventionally in broken lines.

The broken lines in FIG. 1 indicate a common type of gasoline sales pump and register 10, to the case 12 of which the totalizer assembly 14 of the invention is connected. The usual gallons sold dials 18 of the pump are driven by well known means from a flow meter (not illustrated) and a flow control 20, which may be an electric pump or an electrically controlled valve. The control is connected through an on-off switch 22 on the pump by a circuit 24 to a suitable power source. The switch 22 is actuated by the lever 26 on the shaft 28, which is uniformly inter-connected to a re-set mechanism (not shown) for resetting the dials 16 and 18 before each sale. The pump also has non-resettable accumulating dials 30 driven by the shaft 32 whenever the pump is actuated.

The key actuated totalizer assembly 14 operates in the same manner as that disclosed and claimed in my U.S. Patent identified above. The mounting plate 34 is secured over an opening in the wall 12, and carries one end of a flexible drive cable 36 attached by bevel gears 37 to a common drive shaft 40. The other end of the cable 36 carries a coupler 42 adapted to be connected to the shaft 32 of the pump register. The plate also carries a switch 44 with a connecting conductor cable 46 adapted to be connected in series with the circuit 24 by breaking one side of the circuit as at 48 and connecting the conductors 50 to the broken ends. The flow device 20 can not be activated until the switch 44 is closed.

Switch 44 is positioned on the plate 34 to be closed by axially downward movement of one detent slide 52 against spring 54 of the switch. Detent 52, which may be designated as the actuating detent, is locked in down position or to the left in FIG. 4 by the location of the pin 56B carried by the depressed control slide 58B of the lock cylinder 60 being located against the inclined edge 62 in the actuated detent, while the control slide is held down by the retaining notch 64B in the release detent 66 on the reverse side of the control slides 58. The remaining control slides 58 and their pins 56 associated with the unactuated lock cylinders are locked in their raised positions by the blocking shoulders 68 on the actuating detent which moved under or behind them when detent 52 was moved down. The release detent slide 66 has notches therein passing the opposite ends of the pins 56. When the pin 56B was first depressed, it cammed along the inclined edge 70B, moving release detent 66 to the right in FIG. 4 until the pin slipped below the holding shoulder 64B. A spring 74 (see FIG. 1) returned the remaining inclined edges 70 to prevent depression of other control slides and their pins.

In order to release the detent assembly for actuation by another key lock cylinder, the rear or inner side of the mounting plate 34 carries a journal or bearing 76 for a release extension shaft 78. The opposite end of the shaft carries a coupling 80 adapting to be connected to the reset shaft 28 of the register 19. A lever 82 on the extension shaft rotates with the shaft to engage the end of the release detent 66 and move it upwardly or to the right in FIG. 4 so that the cam edge 62, assisted by the spring 86 positioned under the depressed cylinder 60 raises the control slide 58B and its pin 58, and conditions the totalizer and detent assembly for a succeeding operation.

With particular reference in FIGS. 2 and 3, it will be noted that the control slides 58 pass through slots 88 in the base or mounting plate 34 of the totalizer assembly. The lower or inner ends of the control slides are guided through slots 90 in the cross piece of a yoke 92. The yoke has its upper end secured to the plate as by the flanges 94 on the upper ends of its arms. The upper ends of the control slides have laterally turned arms 96 with arcuate slots 98 therein. The slots permit the lock cylinders 60 to rotate within their bodies 100. The bodies, which are rectangular blocks are secured to the plate by means of screws 102 passed through a flange 104 struck from an interior portion of the plate and bent upwardly.

Located between the arms 96 on the control slides and the ends of the lock cylinders 60 are laterally projecting lugs or fingers 106 with angled cam portions 108 which cammingly engage the ends of the axially slidable shafts 110 of the totalizers. The lugs 106 pass radially through slots 112 in the lower ends of the lock bodies, and are connected to the lock cylinders by screws 114 which pass through the arcuate slots 98 in the laterally turned upper ends of the control slides. Off-center studs 116 on the lock cylinders are received in holes in the lugs and co-act with the screws to cause the lugs to rotate with the cylinders. Anti-friction washers 118 assist the movement.

The lock cylinders 60 and their associated bodies 100 desirably have interlocking parts (not illustrated) which prevent rotation and axial motion of the cylinders until the proper key is inserted. Axial motion is prevented except when the key and cylinder are rotated to position the lug 106 in the axial slot 112. Also, the key is not removable from the cylinder until the lug is rotated to the dotted position shown in FIG. 3. To accommodate this motion, a transverse angular slot 120 is cut laterally from the upper end of the axial slot 112. This leaves a shelf 122 which receives and supports the lug 106 in the dotted position in FIG. 3. Since this is the only rotated position in which the key can be removed from the cylinder, the shelf re-inforces the anti-axial motion interlock between the cylinder and the body, and prevents the lock from being forced. Even if the cylinder were hammered enough to break the shelf, the cam portion 108 shown in dotted lines in FIG. 3 would be out of registery with the totalizer shelf. It is thus practically impossible to prevent the totalizer assembly from accomplishing its purpose; which is to require that a proper key be used in the proper lock, thus preventing the delivery of gasoline without the proper non-resettable totalizer in engaged position being being engaged to record the delivery.

The provision of the lugs 106 separate from the control slides 58 permits the use of lock cylinders and bodies which are more or less standardized. Similarly, turning the flange 104 and the walls 124 which support the totalizer shaft 110 from the body of the plate 34 simplifies the use of existing totalizer wheels, shafts, and related parts.

It is pointed out that the attachment 14 has equal utility on pumps having remotely controlled reset mechanism and flow control switches in place of the manual handle on the reset shaft 28 and its mechanical interlock to the flow control switch. The release extension shaft 78 of the attachment can be connected to the remotely controlled reset element of the pump, and the switch 44 may be connected to the flow control circuit 24 either in place of the switch 22, or in series with it. In the latter instance an existing pump with remote controls can be used to make either supervised sales or unsupervised, key controlled sales. A supervised sale made by closing the switch 22 by an attendant would not be recorded in any of the totalizers of the assembly.

The use of locks with keys which are removable only in the off or de-actuated position of the cylinders renders the attachment adaptable for regular supervised sales in that persons responsible for the keys are less likely to leave the pump with their totalizer connected.

What is claimed to be new, and what is desired to be secured by Letters Patent is defined by the following claims:

1. In a totalizer attachment for a gasoline sales pump having plural totalizers on axially shiftable shafts, a key operated lock for each shaft, a control slide actuated by each lock, a control detent and a release detent interlocked by said control slides, a switch arranged to be actuated by said control detent and adapted to be to the delivery circuit of the pump, a release element arranged to actuate said release detent and adapted to be connected to the reset control of the pump, a common drive shaft to which said shiftable shafts are selectively engagable, a connecting element adapted to be drivingly connected between said common shaft and the non-resettable accumulator of said pump, and a mounting plate for said attachment, the improvement which comprises:

means connecting the bodies of said locks to said plate in spaced relation to the ends of said shiftable shafts, lugs connected to the cylinders of said locks and projecting from the bodies of the locks toward said shiftable shafts, and cam portions on said lugs movable therewith in camming engagement across the ends of said shiftable shafts to move the shafts into driven engagement with said common shaft.

2. In the improvement as defined in claim 1, the further improvement in which the means connecting said locks to said plate include a flange turned laterally from an interior portion of said plate.

3. In the improvement as defined in claim 2, other flanges turned from the interior portion of said plate and supporting the slidable shafts of said totalizers.

4. In the improvements as defined in claim 3, said plate having said switch, said release element, and said connecting element supportingly connected to its rear side.

5. In the improvement as defined in claim 1, the cylinders of said locks being rotatable in their bodies only by their keys, and being axially slidable only in their key rotated positions.

6. In the improvement as defined in claim 5, the bodies of the locks defining axially extending slots passing said lugs, and angularly extending transverse slots opening from the axial slots to receive the lugs in the axially retracted positions of the cylinders.

7. In the improvement as defined in claim 6, the control slides having laterally turned flanges on their outer ends defining arcuate slots, and the flanges being secured to the inner ends of the lock cylinders by means of screws passed through the arcuate slots and said lugs to said cylinders.

* * * * *